United States Patent [19]

Gryzinski

[11] 4,360,763

[45] Nov. 23, 1982

[54] METHOD AND DEVICE FOR CONTROL OF GREAT CURRENTS PARTICULARLY OF THE PULSE TYPE

[75] Inventor: Michal Gryzinski, Warsaw, Poland

[73] Assignee: Instytut Badan Jadrowych, Warsaw, Poland

[21] Appl. No.: 125,210

[22] Filed: Feb. 27, 1980

[30] Foreign Application Priority Data

Mar. 13, 1979 [PL] Poland ..... 214086

[51] Int. Cl.[3] ..... H01J 7/24

[52] U.S. Cl. ..... 315/111.01; 313/174; 313/231.01; 315/344; 200/144 B

[58] Field of Search ..... 315/111, 111.1, 340, 315/344, 110; 328/59; 313/7, 175, 231, 231.1, 155, 174, 348; 307/118, 144; 200/144 B, 147 R

[56] References Cited

U.S. PATENT DOCUMENTS

| | | | |
|---|---|---|---|
| 2,996,633 | 8/1961 | Foster | 313/175 X |
| 3,435,287 | 3/1969 | Jacobsen | 315/340 X |
| 3,714,510 | 1/1973 | Hofmann | 313/231 X |
| 4,019,006 | 4/1977 | Strossner | 200/147 R X |

OTHER PUBLICATIONS

Gryzinski, *A New Device for Creating a Strongly Focused Hot Plasma Jet-Rod Plasma Injector*, Nukleonika, vol. 4, No. 7, Aug. 1969, pp. 679–705.

Gryzinski, *Investigations of RPI in Dynamic Gas Conditions*, Nukleonika, vol. 21, No. 11, Dec. 1976, pp. 1225–1236.

*Primary Examiner*—Eugene R. LaRoche

[57] ABSTRACT

Gas density variations between two electrodes are controlled by directing a gas stream into the region between the electrodes. Inside a vacuum chamber there are suitably arranged electrodes in the form of a cathode and an anode, and also a pulse gas source, as well as, preferably, a suitable winding.

7 Claims, 1 Drawing Figure

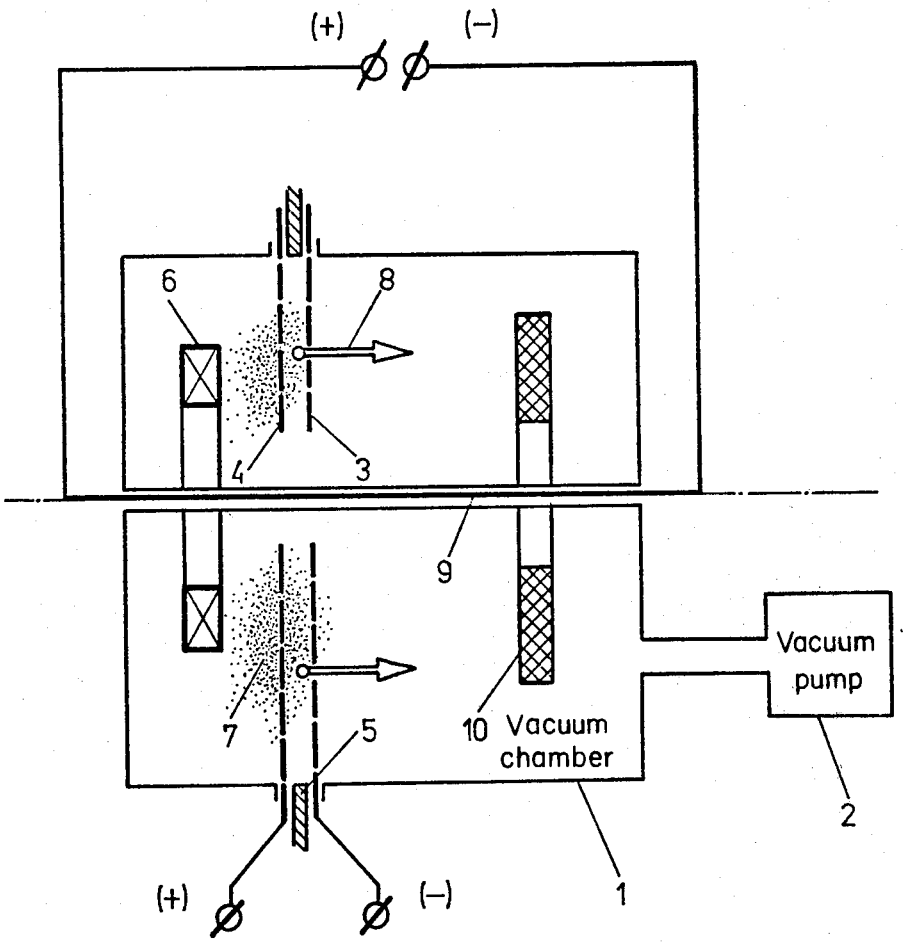
(+)
(−)
6
8
4
3
9
Vacuum pump
7
5
10
Vacuum chamber
2
(+)
(−)
1

METHOD AND DEVICE FOR CONTROL OF GREAT CURRENTS PARTICULARLY OF THE PULSE TYPE

This invention relates to new a method and device for control of great currents, particularly the pulse ones.

This invention is intended for use in some branches of electroengineering industry dealing with the generation and commutation of great currents, and particularly for the design of the current and voltage pulses. The range of use of the latter is extremely diversified, from geology (generation of seismic waves), through quantum electronics, (laser supply), to the physics of plasma and a controlled thermonuclear reaction (creating and maintaining the hot plasma).

Those skilled in art know the method of control of great currents described in the monograph entitled "Technika bolszich impulsnych tokow i magnitnych polej" (Technology of great pulse currents and magnetic fields), Atomizdat, Moscow 1960, wherein self-excited electric discharge by a voltage pulse is initiated in a gas between two electrodes of a spark gap or thyristor making the electric circuit.

Those skilled in the art also know the method of control of great currents described in Journal of Applied Physics, 1970, vol. 41, p. 3894, wherein the current circuit is broken by fuse blow-out.

Also known are devices for the control of great currents in the form of various versions of spark gaps, e.g. the ones described in the above mentioned monograph entitled "Technika bolszich impulsnych tokow i magnitnych polej" (Technology of great pulse currents and magnetic fields), as well as thyratrons or thyristors.

The device for the control of great currents, such as thyratron, being most similar to the one being the subject of this invention has three electrodes disposed in rarefied gas, namely: a hot cathode for emitting electrons, an anode, and a negatively polarized grid lying between both the above mentioned electrodes. A positive voltage pulse is applied to the grid making possible a free movement of the electrons emitted from the cathode towards the anode. The electrons accelerated by an electric field in the vicinity of the anode-cathode ionize the gas filling this area and cause a self-excited discharge to develope.

In all methods so far known neither an infinitely variable control, nor a shaping of the current waves are possible because of the self-excited character of discharge in gas or a non-controllable process of disintegration of the fuse link.

The known devices and methods do not ensure an infinitely variable adjustment (smooth) control of the magnitude of current in the electric circuit and serve only as keying elements, that is they either switch on the electric circuit (spark gaps and thyratrons), or switch it off (fuse links). In order to shape a current pulse it is necessary, as may be seen from the monograph "Technika bolszich tokow i impulsnych magnitnych polej" (Technology of great currents and pulse magnetic fields) to to create electric grids including the keying element, capacitance, inductance and resistance.

The aim of this invention has been the creation of a current flow in a receiver possessing the required time dependance, such as a winding of a magnetic field in physical experiments, or a resistance of a voltage generator to be used for testing various electrical instruments. By forcing a definite current flow one can obtain, in the first case, the required time-dependance of the magnetic field determined by the requirements of the experiments, and, in the second case, the shape of the voltage wave determined by the requirements of the instrument being tested.

In the method according to this invention, wherein an element with an electric discharge in gas has been used, the variations of the gas densities between the two electrodes of the element with an electric discharge are controlled by directing a gas stream into the zone of the electrodes. The electrodes are preferably disposed in a vacuum, and gas is supplied in a pulse-like manner. The gas pressure in the region of the electrodes and the linear dimensions of the said electrodes have been so chosen as to obtain an intensive removal of gas from the region of both the above mentioned electrodes together with the current flow.

In order to ensure such conditions, the parameters of the process and the spacing of the electrodes should be so chosen that the following relation be satisfied:

$$\frac{p\,[pa]\cdot d^2\,[m]}{B\,[T]} \simeq 0.53 \qquad (1)$$

where p is the gas pressure in the gas stream in the vicinity of the electrodes and d is the distance between the electrodes. The magnetic field B is determined by the linear dimensions of the electrodes and is a linear function of current flowing through the electrodes. In case of cylindrical electrodes the following relationship exists between the magnitude of the magnetic field B, the intensity of current flowing through the instrument I and the medium radiis of the electrodes R:

$$B\,[T] \simeq 2\times 10^{-7}\cdot\frac{I[A]}{R[m]} \qquad (2)$$

If the equation (1) is satisfied, at least approximately, then any current flow is accompanied by an intensive displacement of the ionized gas towards the cathode. By using a grid-type (transparent) cathode it is always possible to remove gas from the space between the electrodes. The presence of this gas is necessary for the existence of conductivity. In order to maintain a sufficient current flow a new gas must be continuously supplied to the area between the electrodes. This supply is determined by the following equation:

$$V[\mathrm{pa}\times \mathrm{m}^3/\mathrm{sec}] \simeq 2\times 10^{-1}\times I/A/ \qquad (3)$$

where V is the gas intake speed.

In order to obtain the required conductivity variations of the order of several microseconds, when the gas wave speed is insufficient for modelling the current flow by changing the amount of gas being supplied profiled electrodes with variable spacing therebetween are used and the gas is introduced between the electrodes several times. In such circumstances, the time-dependence of the resultant conductivity will be determined by the velocity of emptying of the individual portions of the inter-electrode region. In order to widen the current range and create an additional possibility of modelling the conductivity it is advisable to use an external magnetic field, either stationary, or varying in time.

The phenomenon of gas sweeping from the inter-electrode region and conductivity variations being an inspiration for the inventors of this invention have been observed during work on rod plasma guns and described in the publication in the journals: Nukleonika, vol. 4, p. 679, 1969 and Nukleonika, vol. 21, p. 1225, 1976.

The device according to this invention includes a chamber and two electrodes: a cathode and an anode. Both these electrodes are transparent and they are isolated from each other by an insulator. Inside said chamber there is a pulse gas source and, preferably, a winding for the generation of a magnetic field, as well as a pumping system located in the vicinity of the cathode. The electrodes, pulse gas source and winding, as well as the pumping system, in the device according to the invention, have preferably a rotational symmetry. The electrodes are made either of straight or of bent rods.

The device and method according to this invention make possible an infinitely variable adjustment (smooth control) of the magnitude of great currents and shaping of the current pulse both during the build-up, as well as during decay of the current pulse.

The invention is explained by way of example of an embodiment presented in the FIGURE showing a principle-block diagram of the device for the control of the flow of great currents.

Inside the vacuum chamber 1, where a high vacuum is produced by means of a vacuum pump 2 there are: a transparent cathode 3 and a transparent anode 4, preferably being one axially symmetrical assembly and insulated from each other in the region of connection with an external circuit by means of a conventional insulator 5. Inside the chamber 1, on the side of the anode 4, there is the required gas source 6, such as e.g. an electromagnetic valve for opening the gas tank in a programmed way. A gas stream (7) entering the inter-electrode area causes in effect the discharges between the electrodes and the current flow determined by the properties of the outer circuit and plasma discharge. Properties of the plasma discharge depend, in turn, on the density and shaping of the gas stream 7 and on the dimensions and shape of the cathode 3 and anode 4. These magnitudes have been so chosen that during a discharge the electrons drifting in the crossed electric and magnetic fields travel a major part of the distance moving along the cathode 3 and anode 4, and ions 8 leave freely the discharge region through the surface of the transparent (grid type) cathode 3. In order to improve the control properties and obtain an additional possibility of influencing the discharging conductivity it is advisable to generate an additional magnetic field perpendicular to the lines of forces of the electric field existing between the cathode 3 and anode 4 by means of a co-axial conductor 9 supplied from a separate current source. The control properties of the controller are preserved until the value of pressure in the inter-electrode region can be controlled. This time is determined by the property of the systems for pumping gas from the vacuum chamber 1. In case of a small pumping speed, the control properties of the controller will be maintained only as long as the chamber is not completely filled with gas. In these circumstances the plasma controller will be suitable only for control of rapid current pulses. In order to make it possible to obtain prolonged control properties, it is advisable to locate a system of high-capacity pumps 10 in direct proximity to the cathode.

I claim:

1. A method of controlling strong currents, in an apparatus including an electric circuit with two electrodes spaced at a distance from each other, comprising the steps of: creating a region of gas between the electrodes, and varying the density of the gas so as to obtain a constant value of the ratio of: the gas pressure, multiplied by the square of the medium distance between the electrodes, and divided by the intensity of the magnetic field produced by current flow in said electric circuit, to thereby remove ionized gas from the space between the electrodes, and producing said gas density variations by directing an additional gas stream with variable density to the space between the electrodes.

2. A method according to claim 1, wherein said gas density variations are produced by a second magnetic field perpendicular to the electric field existing between the electrodes.

3. A method according to claim 2, wherein said second magnetic field is produced by a conductor located axially of the electrodes and supplied with current from a source separate from that for said electric circuit.

4. A method according to any one of claims 1 to 3, wherein said ratio of the gas pressure (P) multiplied by the square of the medium distance between the electrodes ($d^2$) and divided by the magnetic field intensity (B) produced by the current flow between said electrodes is equal to 0.53.

5. An apparatus for controlling high currents, especially high current pulses, comprising: a vacuum chamber, an anode and a cathode arranged in spaced relationship to each other in said vacuum chamber and each being permeable to gas particles, a source of gas pulses, arranged within said vacuum chamber, a current conductor connected to a separate source of current, arranged in such a manner as to generate a magnetic field with lines of force perpendicular to the lines of force of the electric field existing between said anode and said cathode, and sorption pumps in the vicinity of said anode and said cathode.

6. The apparatus according to claim 5, wherein said anode and said cathode are of a grid-like structure.

7. The apparatus according to claim 5, wherein said cathode, said anode and said source of pulses have a common axis of rotational symmetry.

* * * * *